US006872147B2

(12) United States Patent
Shih

(10) Patent No.: US 6,872,147 B2
(45) **Date of Patent: *Mar. 29, 2005**

(54) BILLIARD TABLE HAVING EASILY ASSEMBLING STRUCTURE

(76) Inventor: Tung Yuan Shih, No. 15-3, Chung Shan Road, Hsin Shi Shiang, Tainan Hsien (TW), 744

( * ) Notice: Subject to any disclaimer, the term of this patent is extended or adjusted under 35 U.S.C. 154(b) by 0 days.

This patent is subject to a terminal disclaimer.

(21) Appl. No.: 10/217,103

(22) Filed: Aug. 12, 2002

(65) Prior Publication Data

US 2004/0029644 A1 Feb. 12, 2004

(51) Int. Cl.[7] ..... A63D 15/00; A63D 13/00
(52) U.S. Cl. ..... 473/15; 473/1; 108/115
(58) Field of Search ..... 473/1, 4, 6, 9, 473/10, 12, 14, 15, 16, 18; 108/115

(56) References Cited

U.S. PATENT DOCUMENTS 127,886 A * 6/1872 Hunt ..... 473/15
272,909 A * 2/1883 Shattuck ..... 108/131
317,097 A * 5/1885 Danner ..... 108/132
329,734 A * 11/1885 Gosner ..... 473/15
1,133,109 A * 3/1915 Derbyshire ..... 108/132
3,349,728 A * 10/1967 Barecki et al. ..... 108/131
3,585,945 A * 6/1971 Nielsen ..... 108/177
3,988,021 A * 10/1976 Grover ..... 473/15
5,882,265 A * 3/1999 Benton ..... 473/15
6,149,530 A * 11/2000 Shih ..... 473/22

* cited by examiner

*Primary Examiner*—Mitra Aryanpour
(74) *Attorney, Agent, or Firm*—Charles E. Baxley

(57) ABSTRACT

A billiard table includes a table top, two pairs of brackets secured to the table top and each having one or more openings, two pairs of bars each having one or more ears easily and quickly hooking to the openings of the brackets, for easily and quickly hooking and securing the bars to the table top, and for allowing the billiard table to be assembled by the users. A number of angles are secured between the bars for securing the bars together and to the table top. A bottom plate may be secured to the bars, and a support device may be secured to the bottom plate.

3 Claims, 4 Drawing Sheets

BILLIARD TABLE HAVING EASILY ASSEMBLING STRUCTURE

BACKGROUND OF THE INVENTION

1. Field of the Invention

The present invention relates to a billiard table, and more particularly to a billiard table having an easily assembling structure.

2. Description of the Prior Art

Typical billiard tables comprise a foot support disposed below a table top and comprise a solid configuration that may not be disengaged from each other and that may not be easily moved or transported and assembled together. The typical billiard tables thus include a huge volume that is adverse for storing and transportation purposes.

The present invention has arisen to mitigate and/or obviate the afore-described disadvantages of the conventional billiard tables.

SUMMARY OF THE INVENTION

The primary objective of the present invention is to provide a billiard table including an easily assembling structure for allowing the billiard table to be easily assembled by the users.

The other objective of the present invention is to provide a billiard table including a structure for allowing the billiard table to be folded to a compact configuration and for facilitating the storing and the transportation of the billiard table.

In accordance with one aspect of the invention, there is provided a billiard table comprising a table top including a bottom surface, a first pair and a second pair of brackets secured on the bottom surface of the table top, and two first bars and two second bars detachably secured to the first and the second pairs of brackets respectively, each including a lower portion, and a plurality of angles secured between the first bars and the second bars for securing the first and the second bars together. The bars may be easily and quickly hooked and secured to the table top with the brackets without additional tools or fasteners, for allowing the billiard table to be easily assembled by the users without experts.

The first and the second pairs of brackets each includes at least one opening formed therein, the first and the second bars each includes at least one ear extended therefrom for hooking and engaging into the at least one opening of the first and the second pairs of brackets respectively, and for allowing the bars to be easily and quickly assembled to the table top without additional tools and fasteners, and without experts.

The first and the second bars each includes a board having the at least one ear extended therefrom.

A bottom plate may be secured to the lower portions of the first and the second bars, and a support device may be secured to the bottom plate.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
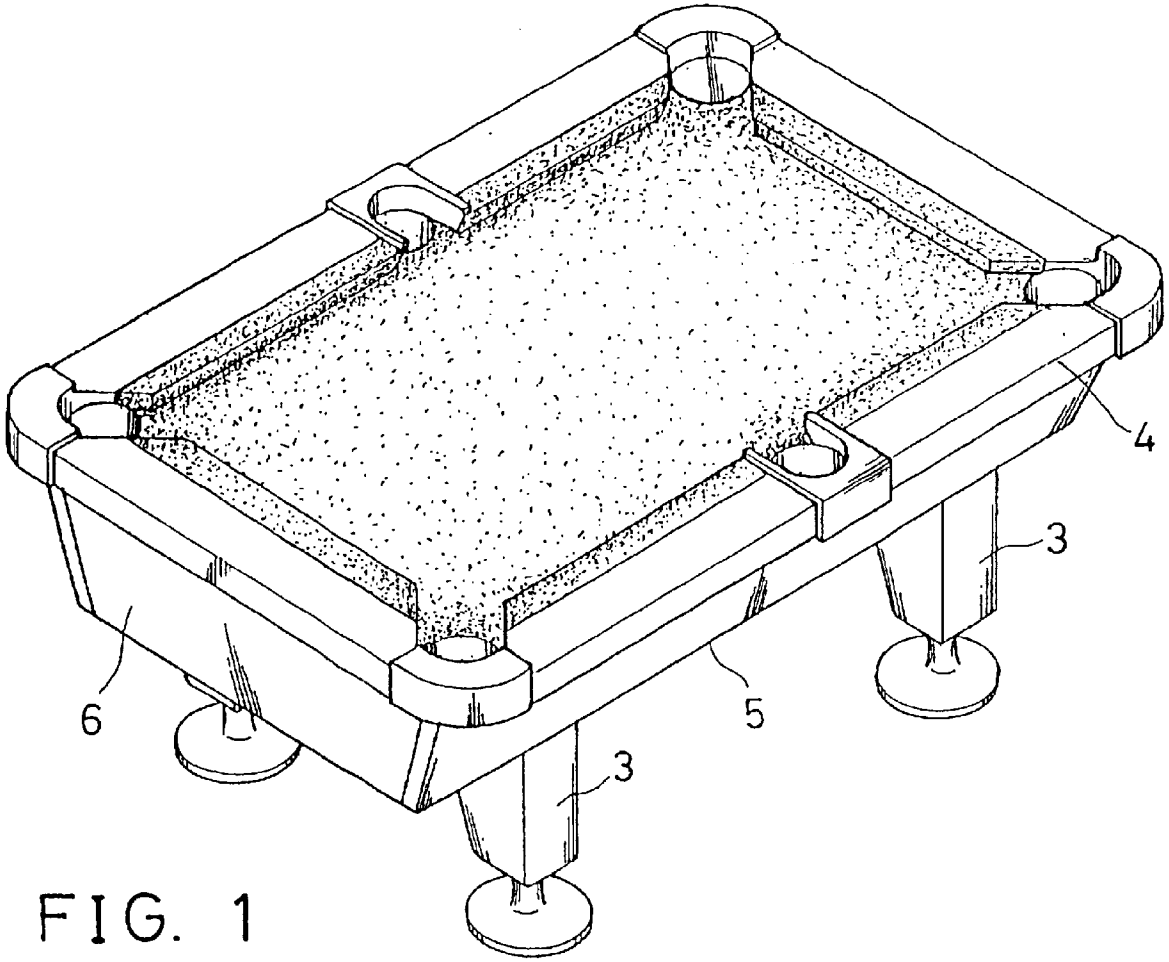
FIG. 1 is a perspective view of a billiard table in accordance with the present invention.
Figure 2:
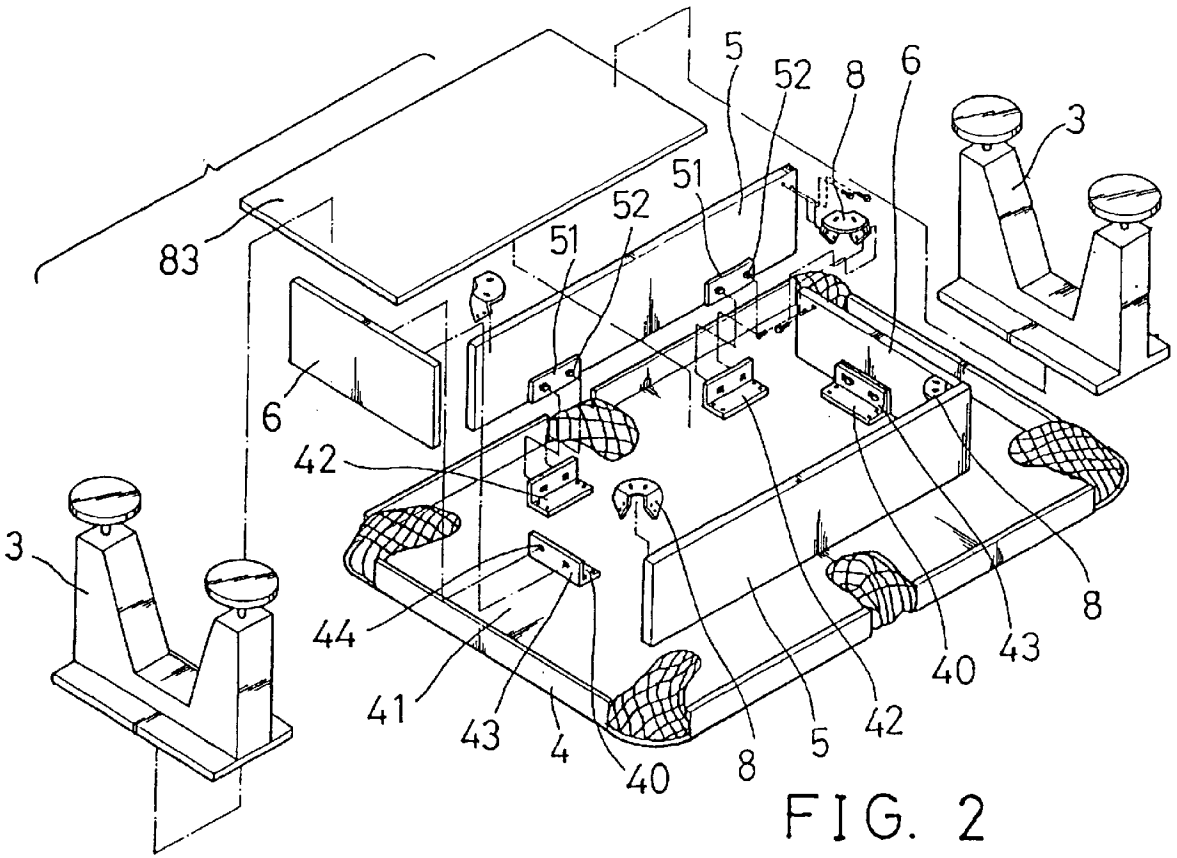
FIG. 2 is a partial exploded view of the billiard table, as seen from the bottom of the billiard table.
Figure 3:
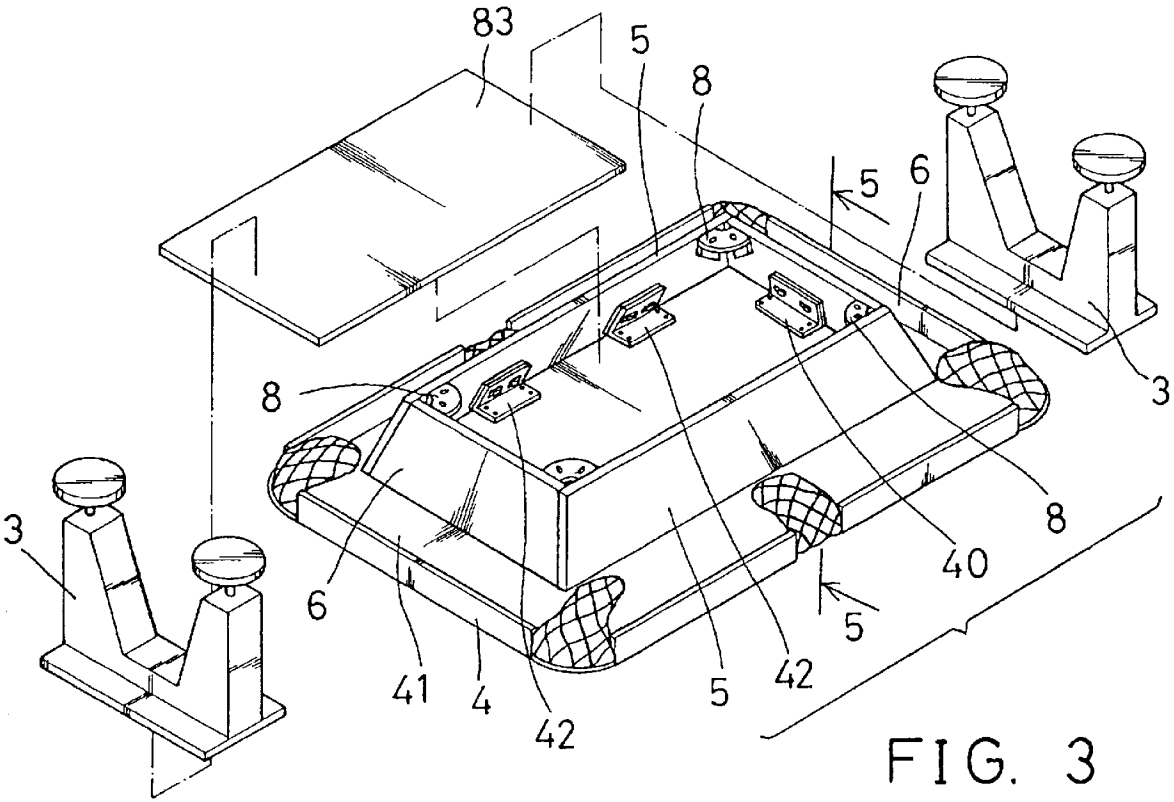
FIG. 3 is a partial exploded view of the billiard table, similar to FIG. 2, also as seen from the bottom of the billiard table, illustrating the assembling operation of the billiard table.

Referring to the drawings, and initially to FIGS. 1–3, a billiard table in accordance with the present invention comprises a table top 4 including a bottom portion or a bottom surface 41. Four or two pairs of bars 5, 6 each includes an upper portion to be secured to the bottom surface 41 of the table top 4, and arranged in a square or a parallelogramic structure. The pair of bars 5 are parallel to each other, and the other pair of bars 6 are parallel to each other.

The table top 4 includes one or more pairs of angles or brackets 42 disposed thereon, such as parallel to the longer sides, for supporting the bars 5, and one or more pairs of angles or brackets 40 disposed thereon, such as parallel to the shorter sides, for supporting the other pair of bars 6.

The brackets 40, 42 are secured to the bottom surface 41 of the table top 4, and each includes a panel 43 extended therefrom, and preferably inclined or perpendicular to the table top 4. The panels 43 each includes one or more openings 44 formed therein.

Figure 4:
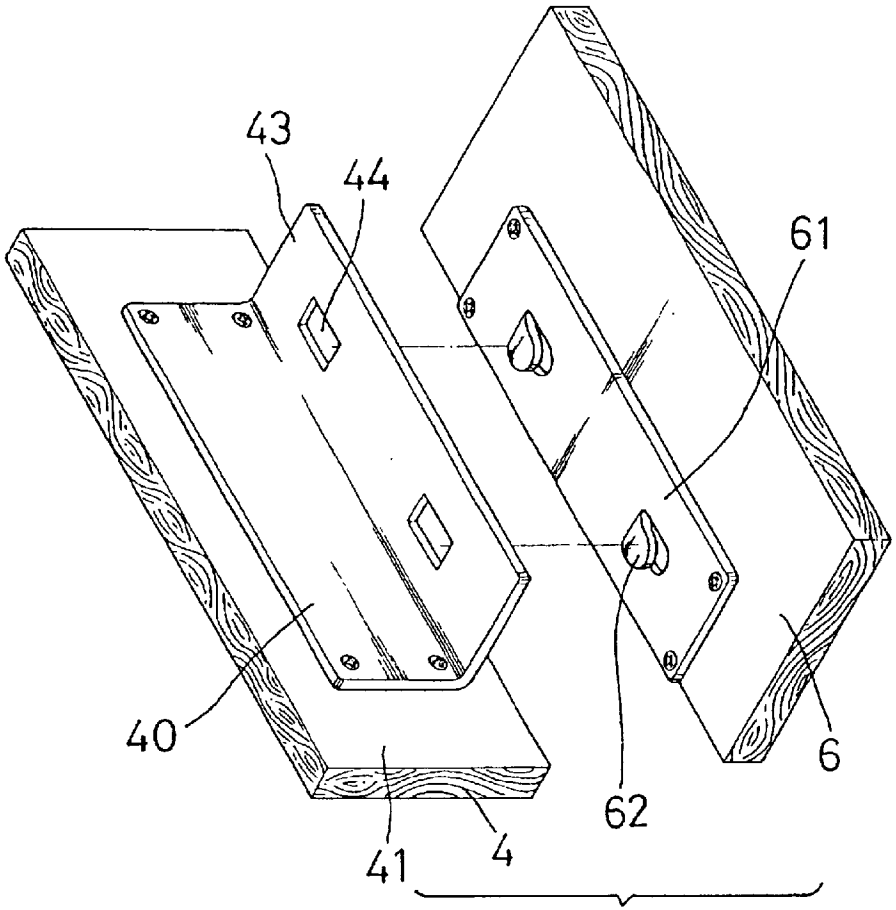
FIG. 4 is a further partial exploded view of the billiard table, illustrating the assembling operation of the billiard table.
Figure 5:
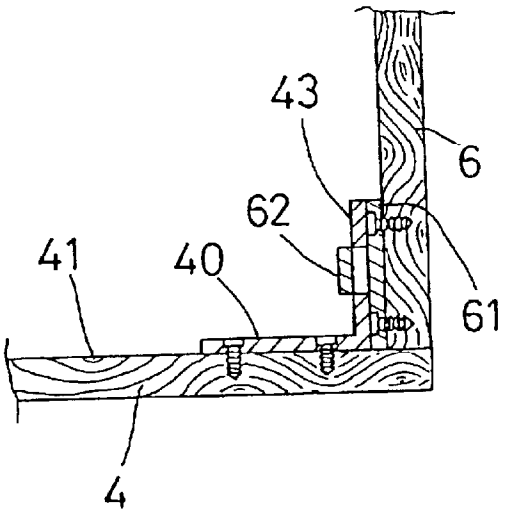
FIG. 5 is a partial cross sectional view taken along lines 5—5 of FIG. 3.

The bars 5, 6 each includes one or more boards 51, 61 secured thereto and preferably made of stronger materials, such as the metal, the plastic, the synthetic materials, etc. The boards 51, 61 each includes one or more ears 52, 62 extended therefrom for detachably engaging into the openings 44 of the panels 43, and for allowing the bars 5, 6 to be easily and quickly and detachably engaged and assembled onto the brackets 40, 42 of the table top 4, best shown in FIGS. 3–5.

Alternatively, the bars 5, 6 may also be formed by molding processes, and may have the ears 52, 62 directly extended therefrom during the molding processes, for example.

Four angles 8 may be secured between the bars 5, 6 and/or the table top 4, for securing the bars 5, 6 to the table top 4 as shown in FIG. 3, after the ears 52, 62 of the bars 5, 6 have been engaged or hooked to the brackets 40, 42.

As best shown in FIG. 3, it is preferable that the bars 5, 6 are slightly inclined relative to the table top 4 when the bars 5, 6 have been secured to the table top 4 by the brackets 40, 42 and the angles 8. A plate 83 (FIG. 3) may be secured to the bottom portions of the bars 5, 6 with fasteners or the like. A support device includes two foot supports 3 which may be secured to the bottom of the plate 83 with fasteners, for example.

In operation, as shown in FIGS. 3–6, the foot supports 3 may be engaged or secured onto or disengaged from the bottom plate 83, and the bottom plate 83 may be engaged or secured onto or disengaged from the bars 5, 6, and the angles 8 may be engaged or secured onto or disengaged from the bars 5, 6, and the bars 5, 6 may be hooked or secured onto or disengaged from the brackets 40, 42 of the table top 4, such that the billiard table may be disassembled and folded to a compact folding structure that is excellent for storing and transportation purposes, and may be easily assembled by the users without experts.

Accordingly, the billiard table in accordance with the present invention includes a structure for allowing the billiard table to be folded to a compact configuration and for facilitating the storing and the transportation of the billiard table.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A billiard table comprising:

a table top including a bottom surface, a first pair and a second pair of brackets secured on said bottom surface of said table top, two first bars and two second bars detachably secured to said first and said second pairs of brackets respectively, each including a lower portion, a plurality of angles secured between said first bars and said second bars for securing said first and said second bars together, a bottom plate secured to said lower portions of said first and said second bars, and a support device secured to said bottom plate.

2. The billiard table according to claim 1, wherein said first and said second pairs of brackets each includes at least one opening formed therein, said first and said second bars each includes at least one ear extended therefrom for hooking and engaging into said at least one opening of said first and said second pairs of brackets respectively.

3. The billiard table according to claim 2, wherein said first and said second bars each includes a board having said at least one ear extended therefrom.

* * * * *